US006886455B2

(12) United States Patent
Pietikäinen

(10) Patent No.: US 6,886,455 B2
(45) Date of Patent: May 3, 2005

(54) METHOD FOR PROFILING A PAPER WEB

(75) Inventor: Reijo Pietikäinen, Jarvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/297,535

(22) PCT Filed: Jun. 6, 2001

(86) PCT No.: PCT/FI01/00534

§ 371 (c)(1),
(2), (4) Date: Jul. 7, 2003

(87) PCT Pub. No.: WO01/94696

PCT Pub. Date: Dec. 13, 2001

(65) Prior Publication Data

US 2004/0025719 A1 Feb. 12, 2004

(30) Foreign Application Priority Data

Jun. 7, 2000 (FI) ..... 20001362

(51) Int. Cl.[7] ..... B30B 13/00
(52) U.S. Cl. ..... 100/35; 100/41
(58) Field of Search ..... 100/35, 38, 161–167, 100/331, 155 R, 41; 162/203, 205, 206, 207

(56) References Cited

U.S. PATENT DOCUMENTS 4,128,053 A 12/1978 Kankaanpää
4,366,752 A 1/1983 Koski
5,655,442 A 8/1997 Conrad et al.
5,669,295 A 9/1997 Kayser et al.
5,791,242 A 8/1998 Kayser et al.
5,911,174 A 6/1999 Cramer et al.
6,666,135 B1 * 12/2003 Brendel et al. ..... 100/47
6,708,608 B2 * 3/2004 Viljanmaa ..... 100/38

FOREIGN PATENT DOCUMENTS

JP 5-209394 8/1993
WO WO 01/94696 A1 12/2001

OTHER PUBLICATIONS

Search Report issued in Finnish Priority Patent Application No. 20001362.
International Search Report issued in International Patent Application No. PCT/FI01/00534.
International Preliminary Examination Report issued in International Patent Application No. PCT/FI01/00534.

* cited by examiner

*Primary Examiner*—Allen Ostrager
*Assistant Examiner*—Jimmy T Nguyen
(74) *Attorney, Agent, or Firm*—Stiennon & Stiennon

(57) ABSTRACT

A paper web is profiled in a multiroll calender which includes at least an upper set of rolls having at least one calendering nip which profiles the paper web on one side; at least one lower set of rolls having at least one calendering nip which profiles the paper web on the other side; and a reversing nip between the upper set of rolls and the lower set of rolls. Both sides of the web are profiled in calendering nips before a nip which does not profile the web.

14 Claims, 2 Drawing Sheets

METHOD FOR PROFILING A PAPER WEB

CROSS REFERENCES TO RELATED APPLICATIONS

This application is a U.S. national stage application of International Application No. PCT/FI01/00534, filed Jun. 6, 2001, and claims priority on Finnish Application No. 20001352 filed Jun. 7, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for profiling a fibrous web, advantageously a paper web, in a multiroll calender which includes: at least an upper set or stack of rolls having at least one calendering nip which is formed in a cross-direction of the web between two rolls and which profiles a first side of the web in the cross-direction by regulating distribution of load to the first side in the nip in a cross-machine direction; at least one lower set or stack of rolls having at least one calendering nip which is formed in the cross-direction of the web between two rolls and which profiles a second side of the web opposite to the first side in the cross-direction by regulating distribution of load to the second side in the nip in the cross-machine direction; and a reversing nip which does not profile the web and which is formed between the lowermost roll of the upper set or stack of rolls and the uppermost roll of the lower set or stack of rolls.

In today's multiroll calenders, calendering takes place by the method "from the top downward", i.e. paper is passed first through a top nip to an upper set of rolls, in which only one of the paper surfaces is calendered. After that, paper is passed through a reversing nip to a lower set of rolls, in which the other surface is treated. Further, to control the CD profile of the caliper and surface properties of the paper, the top and bottom nips are generally provided with a profiling operation in which the distribution of the load applied to the paper is regulated in the cross direction. This kind of prior art arrangement is shown in FIG. 1, which shows a multiroll calender comprising ten rolls. In this calender, the calendering nips profiling the web are the first and the ninth nip. In that connection, calendering takes place according to the principle that the bottom surface of the web is calendered first four times in the set of rolls situated above the reversing nip, said set of rolls comprising hard-surfaced thermo rolls 3 and soft-surfaced backing rolls 2, for example, polymer-covered rolls, after which the web is passed through the reversing nip, which is followed by calendering of the top surface of the web four times in the lower set of rolls situated beneath the reversing nip, said set of rolls comprising hard-surfaced thermo rolls 3 and soft-surfaced backing rolls 2, for example, polymer-covered rolls. Thus, the side of the web to be treated at each particular time is against a thermo roll of the multiroll calender. In the sets of rolls, the transfer of the web from one nip to the next is guided by means of guide rolls 4.

In the conventional construction, the upper and lower parts of the set of rolls thus apply calendering to the different surfaces of the paper. From the point of view of the paper, the situation is, however, very different in the upper and in the lower set of rolls, even though the situation would involve equal loading. In the first nip, paper is uncalendered, porous, moist and, at least in off-line arrangements, cool. In the lowermost nips, paper has already been compressed almost to its final density and, as a result of successive nip contacts, the paper has become considerably warmer (the average temperature has increased by about 40–50° C.) and dried (at least 2–3 percentage units). Thus, treatment of the different sides of the paper is performed in succession and in markedly different conditions.

It is known that in constant conditions under successive compression loads, most of the permanent compression of paper is produced during the first (1–5) times of loading. After that, the paper has already become compressed for the most part and deformations are more elastic, i.e. reversible. In practice, however, the warming of paper increases the amount of plastic compression of paper in the lower set of rolls. On the other hand, it may be thought that compression is higher in the first nips because of the higher moisture content of the paper.

Further, the gradient effects of calendering are more marked in the upper set of rolls because of a large temperature difference created between the thermo roll and the interior of cool paper. By contrast, in the bottom nip where paper has already warmed up by the effect of the preceding nips, it is not possible to achieve a corresponding temperature gradient with the same roll temperature. It may thus be noted that the gradient effects are more distinct in the first nips in the upper set of rolls and the operation of the lower set of rolls is based more on the compression of the paper structure which has been warmed throughout.

In conventional arrangements, profiling that takes place in the top nip operates relatively effectively, whereas it has been observed in practice that in the bottom nip the profiling of the surface properties of paper is rather ineffective, often even insufficient.

The primary aim of the present invention is to remove or at least to reduce the above-mentioned drawbacks, weaknesses associated with conventional calendering, and to provide an improved calendering method in order to assure profiling of the surface properties of both sides of paper in a more effective manner than before and to achieve an increased quality effect and a reduction in the dimensioning and loading values of the profiling devices when profiling becomes easier, which saves roll covers.

SUMMARY OF THE INVENTION

The invention is thus based on the novel and inventive basic idea that the first side and the second side of the web are profiled in calendering nips before the reversing nip.

In the arrangement according to the invention, profiling advantageously takes place in a situation in which a high temperature gradient is achieved for paper and the moisture content of paper is higher. In that connection, the calendering work used for profiling provides an increased quality effect, i.e. higher profiling efficiency. At the same time, as a by-product the advantage is achieved that the set of rolls is "separated" by means of the paper web from the other surrounding air space, which reduces evaporation from the paper web occurring on the set of rolls as well as heat loses from thermo rolls. An advantage is also that on the long web run from the bottom nip to the top nip it is easy to use, for example, moisturizing profiling, which facilitates disposition and optimisation of location. Further, because of the long web run, paper is cooled and, in the next nip, good conditions are again achieved for generation of a temperature gradient.

BRIEF DESCRIPTION OF THE DRAWINGS

The invention and some of its embodiments regarded as advantageous are described in the following with reference to the appended patent drawing in which.

DESCRIPTION OF THE PREFERRED EMBODIMENTS

Figure 1:
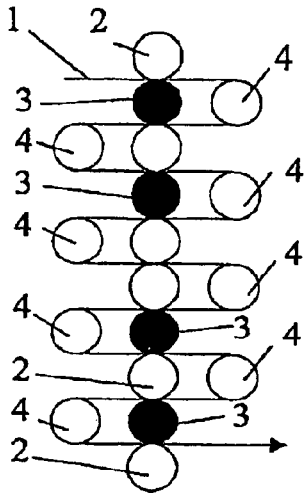
PRIOR ART FIG.1.
FIG. 1 shows a prior Art Calender.

In accordance with the basic principle of the invention, a web is arranged to be passed in a multiroll calender which includes thermo rolls 3 and their backing rolls 2 such that a paper web 1 runs from one nip into the next via guide rolls 4 guiding the run of the web 1 through one or more web-profiling upper nips of an upper set of rolls situated above a reversing nip/nips or an intermediate nip/nips of a set of reversing rolls which does not profile the web and through one or more web-profiling lower nips of a lower set of rolls situated beneath the reversing nip/nips or the intermediate nip/nips of the set of reversing rolls which does not profile the web before non-web-profiling calendering in the reversing nip/nips or in the intermediate nip/nips.

The multiroll calender comprises a calender frame having the set of reversing rolls in the middle in the vertical direction, said set of rolls being formed of two hard rolls defining between them a non-web-profiling reversing nip. In addition, the multiroll calender has the upper set of rolls above the set of reversing rolls and the lower set of rolls beneath the set of reversing rolls.

The upper set of rolls comprises, arranged one upon the other in a stack, groups formed of a soft roll 2, advantageously a shoe roll provided with an internal loading shoe and, for example, with a polymer cover, and of a heatable calender roll, i.e. so-called thermo roll 3. There are two of these groups in the upper set of rolls in the example case of the ten-roll multiroll calender shown in FIGS. 1, 2A, 2B and 3, in which connection said thermo rolls 3 and soft rolls 2 of the upper set of rolls form calendering nips together with the upper hard roll of the set of reversing rolls, of which nips the nip between the uppermost soft roll 2 and the heatable calender roll beneath it is a soft nip which profiles the web and the other soft calendering nips in connection with the thermo roll 3 of the upper set of rolls do not profile the web.

The lower set of rolls comprises, arranged one upon the other in a stack beneath the set of reversing rolls, groups formed of a heatable calender roll, i.e. so-called thermo roll 3, and of a soft roll 2, advantageously a shoe roll provided with an internal loading shoe and, for example, with a polymer cover. There are two of these groups in the lower set of rolls in the example case of the ten-roll multiroll calender shown in FIGS. 1, 2A, 2B and 3, in which connection said thermo rolls 3 and soft rolls 2 of the lower set of rolls form calendering nips together with the lower hard roll of the set of reversing rolls, of which nips the nip between the lowermost soft roll 2 and the heatable calender roll 3 above it is a soft nip which profiles the web and the other soft calendering nips in connection with the thermo roll 3 of the lower set of rolls do not profile the web.

When the calendering nip does not profile the web, it is sufficient that the thermo roll 3 is deflection-compensated. When the calendering nip profiles the web, it is advantageous that the thermo roll 3 is deflection-compensated and zone-controlled, which enables the roll to profile in the cross direction transverse to the running direction of the web 1.

Figure 2A:
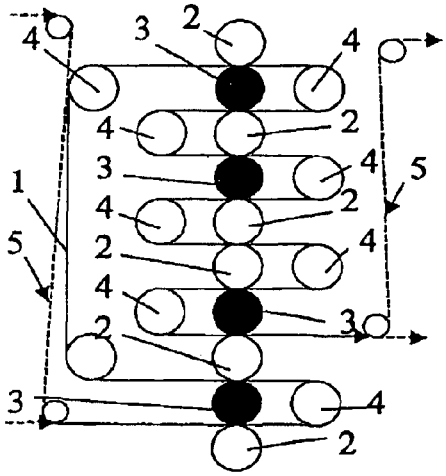
FIG. 2A shows a first preferred embodiment of the invention.
Figure 2B:
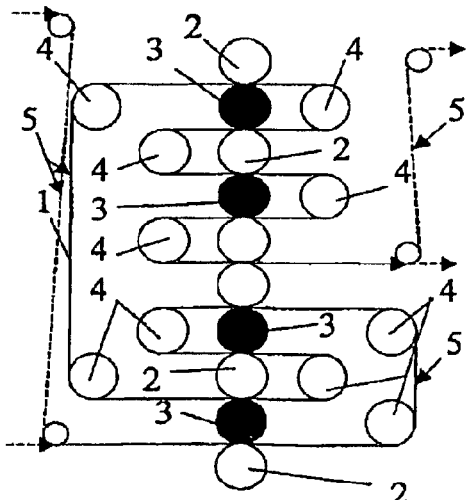
FIG. 2B shows a second preferred embodiment of the invention.

The basic principle of the invention and some of its variants have been illustrated in FIGS. 2A and 2B.

As can be seen in FIG. 2A, the web has been arranged to be passed such that the paper web arrives first at the bottom nip of a lower set of rolls of a calender having a reversing nip and the lower set of rolls beneath it and an upper set of rolls above it, which bottom nip is thus the first nip in the running direction of the web and in which the top surface of the web is profiled. Next, the paper web is passed into a second nip in the running direction of the web, which nip has been arranged to be a nip above the first nip and which nip does not profile the web. From the second nip, the web is passed into the top nip of the upper set of rolls of the calender, which nip is a profiling nip and in which the bottom surface of the web is profiled. By this means, profiling of both sides of the web can be accomplished in the first and the third nip, i.e. in a range of temperature which is substantially smaller than the range of temperature in the conventional web run in an equivalent ten-roll calender between the first and the ninth nip. After the second profiling nip, i.e. the third nip, the web run is substantially similar to the conventional web run, i.e. the web has been arranged to run in the calender from above downward, first through the non-web-profiling nips of the upper set of rolls, then through the reversing nip and finally through the non-web-profiling nips of the lower set of rolls, for example, to reeling.

In the variant of FIG. 2A illustrated in FIG. 2B, the web run differs from that described in connection with FIG. 2A above in that the web run is different between the profiling nip of the lower set of rolls and the profiling nip of the upper set of rolls. In this embodiment shown in FIG. 2B, the web run has been arranged such that the paper web comes first, as also in the embodiment of FIG. 2A, into the bottom nip of the lower set of rolls of the calender having a reversing nip and the lower set of rolls beneath it and the upper set of rolls above it, which bottom nip is thus the first nip in the running direction of the web and in which the top surface of the web is profiled. Next, the paper web is passed into a second nip in the running direction of the web, which nip has been arranged to be a nip beneath the reversing nip and which does not profile the web. From the second nip, the web is passed through and via a third and a fourth calendering nip of the lower set of rolls, which nips do not profile the web and are situated one above the other beneath the second nip and above the first nip, into the top nip of the upper set of rolls, which nip is a profiling nip and in which the bottom surface of the web is profiled. By this means, profiling of both sides of the web can be accomplished in the first and the fifth nip, i.e. in a range of temperature which is substantially smaller than the range of temperature in the conventional web run in an equivalent ten-roll calender between the first and the ninth nip. After the second profiling nip, i.e. after the fifth nip, the web run is substantially similar to the conventional web run, i.e. the web has been arranged to run in the calender from above downward, first through the non-web-profiling nips of the upper set of rolls, then through the reversing nip, for example, to reeling.

Figure 6:
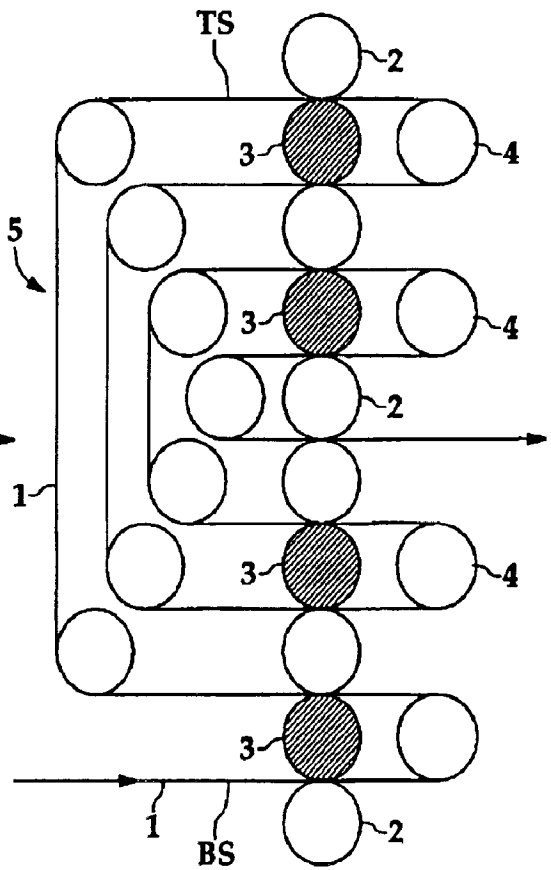
FIG. 6 show a still further embodiment for calendering the web.
Figure 5:
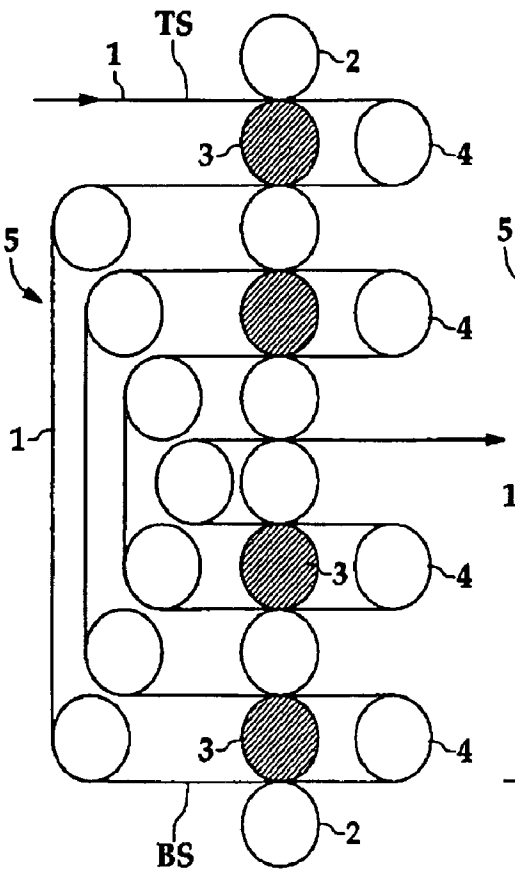
FIG. 5 shows a yet further embodiment for calendering the web.
Figure 4:
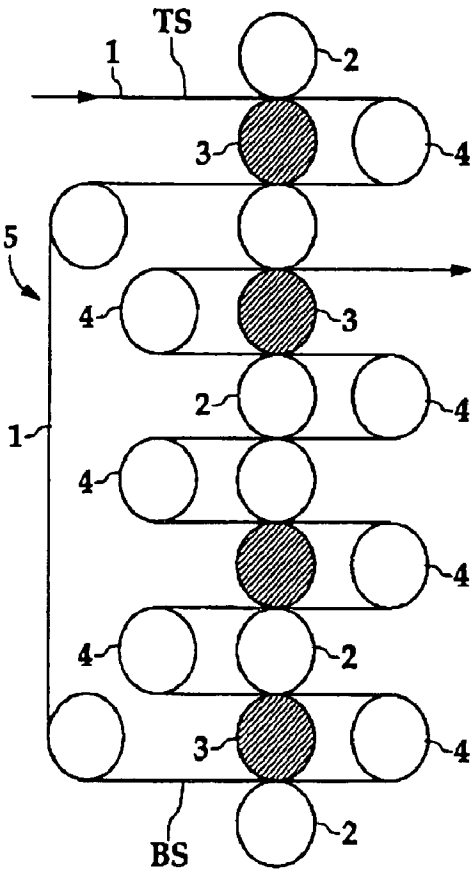
FIG. 4 shows a further embodiment for calendering the web.

It must be emphasized that the web run so far has been described above only by means of two embodiments. These arrangements are, of course, by no means the only possible arrangements but any arrangement in which the web run can be shortened from the conventional one between "the first and the last" nip profiling the opposite sides of the web. Hence, in a ten-roll calender it is possible to select as the calendering arrangement, for example:

as shown in FIG. 4 first calendering of the top surface (TS) twice, then calendering of the bottom surface (BS) four times and finally calendering of the top surface (TS) twice, as shown in FIG. 5 first calendering of the bottom surface (BS) twice, then calendering of the top surface (TS) twice, then calendering of the bottom surface (BS) twice and finally calendering of the top surface (TS) twice, as shown in FIG. 6 first calendering of the top surface (TS) twice, then calendering of the bottom surface (BS) twice, then calendering of the top surface (TS) twice and finally calendering of the bottom surface (BS) twice.

Figure 3:
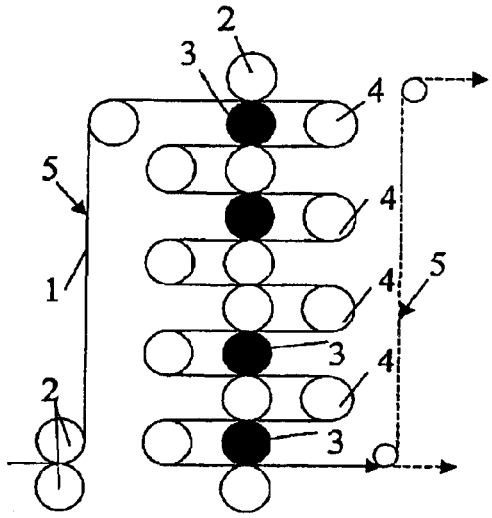
FIG. 3 shows an embodiment for calendering a web.

It is also possible to arrange a separate profiling nip. This kind of arrangement has been shown in FIG. 3. As can be seen in FIG. 3, the separate profiling nip is formed of two rolls 2 placed against each other and arranged before the first nip of the calender in the running direction of the web. This kind of separate profiling nip makes it possible to profile both surfaces of the web at the same time, which provides the advantage that the profiling of both sides of the web takes place at the same temperature. In connection with a separate profiling nip, the web run can be arranged without making any changes to the conventional web run, i.e. the web run can be arranged to take place in the calender from above downward, first through an upper set of rolls, then through a reversing nip and finally through a lower set of rolls to reeling. Naturally, the early profiling of both sides of the web described in connection with FIGS. 2A and 2B can also be used in the calender.

Further, it shall be noted that the invention has been described above only in connection with a ten-roll calender. The number of rolls is, however, of no significance to the applicability of the present invention. Thus, the present invention can be applied to any multiroll calender, for example, to a multiroll calender in which the number of rolls is not ten, but there are preferably an even number of rolls, such as, for example, 4, 6, 8, 12, etc.

With reference to FIGS. 2A and 2B, it is characteristic of the invention that on the inlet and the outlet side of the multiroll calender the web 1 has been arranged to run as substantially vertical draws 5. These vertical draws 5 enclose the multiroll calender inside a web run loop, for example, in a hood-like manner. By this means it is possible to substantially reduce air and heat flows from the calender and to achieve considerable benefits in energy economy.

Above, the invention has been described only by way of example by means of some of its embodiments considered to be advantageous. The invention is, of course, not meant to be limited by this and, as is clear to a person skilled in the art, numerous alternative arrangements and modifications are feasible within the scope of protection of the new and inventive idea defined in the appended claims.

What is claimed is:

1. A method for profiling a fibrous web in a multiroll calender, the multiroll calendar having an upper set or stack of rolls having a lowermost roll, and the multiroll calender having a lower set or stack of rolls having an uppermost roll, and the multiroll calender having a reversing nip which does not profile the web formed between the lowermost roll and the uppermost roll, the method comprising the steps of:

profiling a first side of the web in the upper set or stack of rolls having at least one first calendering nip which is formed in a cross-direction of the web between two rolls and which profiles the first side of the web in the cross-direction of the web by regulating distribution of load to the first side in the nip in a cross-machine direction;

profiling a second side of the web in the lower set or stack of rolls having at least one second calendering nip which is formed in the cross-direction of the web between two rolls and which profiles a second side of the web opposite to the first side in the cross-direction by regulating distribution of load to the second side in the nip in the cross-machine direction; and passing the web through the reversing nip which does not profile the web and, wherein the first side is profiled in the first calendering nip and the second side of the web is profiled in the second calendering nip before passing the web through the reversing nip.

2. A method for profiling a fibrous web in a multiroll calender, the multiroll calendar having an upper set or stack of rolls, having a lowermost roll, and the multiroll calender having a lower set or stack of rolls, having an uppermost roll, and the multiroll calender having a reversing nip which does not profile the web formed between the lowermost roll and the uppermost roll, the method comprising the steps of:

profiling a first side of the web in the lower set or stack of rolls having at least one first calendering nip which is formed in a cross-direction of the web between two rolls and which profiles the first side of the web in the cross-direction of the web by regulating distribution of load to the first side in the nip in a cross-machine direction;

profiling a second side of the web in the upper set or stack of rolls having at least one second calendering nip which is formed in the cross-direction of the web between two rolls and which profiles a second side of the web opposite to the first side in the cross-direction by regulating distribution of load to the second side in the nip in the cross-machine direction; and passing the web through the reversing nip which does not profile the web and, wherein the first side is profiled in the first calendering nip and the second side of the web is profiled in the second calendering nip before passing the web through the reversing nip; wherein the first calender nip is a lowermost calendering nip of the lower set or stack of rolls situated beneath the reversing nip of the multiroll calender, and wherein the second calender nip is an uppermost calendering nip of the upper set or stack of rolls situated above the reversing nip of the multiroll calender, and that after the web is profiled in the uppermost nip of the upper set or stack of rolls the web is arranged to run from the uppermost calendering nip downward first through non-web-profiling nips of the upper set or stack of rolls, then through the reversing nip.

3. The method of claim 2, wherein the first calendering nip is a lowermost nip of the lower set or stack of rolls situated beneath the reversing nip, so that after profiling the first side of the web in the lowermost profiling nip the web is arranged to run from above downward through remaining calendering nips situated one above the other, said remaining calender nips positioned beneath the reversing nip and above the lowermost nip of the lower set or stack of rolls; and wherein the second calendering nip is an uppermost nip of the upper set or stack of rolls situated above the reversing nip, and that after the web runs through the uppermost profiling nip the web is arranged to run from the uppermost profiling nip downward through remaining calendering nips of the upper set or stack of rolls and then through the reversing nip.

4. The method of claim 1 wherein the multiroll calender has ten rolls and the order of calendering is selected from the group consisting of:

first calendering the first side of the web twice, then calendering the second side of the web four times and finally calendering of the first side of the web twice, first calendering the second side of the web twice, then calendering the first side of the web twice, then calendering the second side of the web twice and finally calendering the first side twice, and first calendering the first side twice, then calendering the second side of the web twice, then calendering the first side of the web twice and finally calendering the second side of the web twice.

5. The method of claim 1, wherein the multiroll calender has an even number of rolls.

6. The method of claim 1, wherein, at an inlet side and an outlet side of the multiroll calender, the web is arranged to run substantially as vertical draws.

7. The method of claim 6, wherein the multiroll calender is enclosed inside a loop of the web by means of the vertical draws of the web.

8. A method of calendering a paper web in a calender of the type composed of a stack of at least four calendering rolls each calender roll forming at least one nip with an adjacent calender roll to form the stack, the calender having a first cross machine direction profiling nip between a soft roll and a thermo roll, the calender having a second cross machine direction profiling nip between a second soft roll and a second thermo roll, the calender also having a reversing nip formed between two soft calender rolls positioned in the stack between the first cross machine direction profiling nip and the second cross machine direction profiling nip; the method of calendering comprising the steps of:

profiling a first side of the paper web in the first cross machine direction profiling nip, by regulating distribution of load to the first side in the nip in a cross-machine direction followed by, profiling a second side of the paper web in the second cross machine direction profiling nip, by regulating distribution of load to the second side in the nip in the cross-machine direction and after the first and second sides of the paper web have been profiled passing the web through the reversing nip.

9. The method of claim 8, wherein the first cross machine direction profiling nip is the lowermost calendering nip in the stack of calendering rolls and the web is arranged to run first into the lowermost calendering nip of the calendering rolls in order to profile the first side of the web, and wherein said first nip is situated beneath the reversing nip in the calender, and wherein the second cross machine direction profiling nip is the uppermost calendering nip in the stack of calendering rolls and the web is arranged to run secondly into the uppermost calendering nip of the calendering rolls in order to profile the second side of the web, and wherein said second nip is situated above the reversing nip in the calender; and wherein after the profiling in the uppermost nip of the calender, the web is arranged to run from the uppermost calendering nip downward first through at least one non-web-profiling nip of the calender, then through the reversing nip.

10. The method of claim 8, wherein the first cross machine direction profiling nip is the lowermost calendering nip in the stack of calendering rolls and the web is arranged to run first into the lowermost calendering nip of the calendering rolls in order to profile the first side of the web, and wherein said first nip is situated beneath the reversing nip in the calender, and that after the lowermost profiling nip the web is arranged to run from above downward trough remaining calendering nips at least one non-web-profiling nip of the calender positioned beneath the reversing nip and above the lowermost nip of the stack of calendering rolls;

wherein the second cross machine direction profiling nip is the uppermost calendering nip in the stack of calendering rolls and the web is arranged to run secondly into the uppermost calendering nip of the calendering rolls in order to profile the second side of the web, and wherein said second nip is situated above the reversing nip in the calender; and wherein after the profiling in the uppermost nip of the calender, the web is arranged to run from the uppermost calendering nip downward first through at least one non-web-profiling nip of the calender, then through the reversing nip.

11. The method of claim 8, wherein the calender has ten rolls and the order of calendering is selected from the group consisting of:

first calendering the first side of the web twice, then calendering the second side of the web four times and finally calendering the first side of the web twice, first calendering the second side of the web twice, then calendering the first side of the web twice, then calendering the second side of the web twice and finally calendering first side twice, and first calendering the first side twice, then calendering the second side of the web twice, then calendering first side of the web twice and finally calendering the second side of the web twice.

12. The method of claim 8, wherein the multiroll calender has an even number of rolls.

13. The method of claim 8, wherein, at an inlet side and an outlet side of the calender, the web is arranged to run substantially as vertical draws.

14. The method of claim 13, wherein the calender is enclosed inside a loop of the web by means of the vertical draws of the web.

* * * * *

UNITED STATES PATENT AND TRADEMARK OFFICE

CERTIFICATE OF CORRECTION

PATENT NO. : 6,886,455 B2
DATED : May 3, 2005
INVENTOR(S) : Reijo Pietikäinen

It is certified that error appears in the above-identified patent and that said Letters Patent is hereby corrected as shown below:

Column 8,
Line 20, "trough" should be -- through --
Line 21, delete "remaining calendering nips"

Signed and Sealed this

Twelfth Day of July, 2005

JON W. DUDAS
*Director of the United States Patent and Trademark Office*